US009793593B1

(12) United States Patent
Aster

(10) Patent No.: US 9,793,593 B1
(45) Date of Patent: Oct. 17, 2017

(54) POWER COMBINERS AND DIVIDERS INCLUDING CYLINDRICAL CONDUCTORS AND CAPABLE OF RECEIVING AND RETAINING A GAS

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 0 days.

(21) Appl. No.: 15/493,591

(22) Filed: Apr. 21, 2017

Related U.S. Application Data

(63) Continuation-in-part of application No. 15/043,570, filed on Feb. 14, 2016, now Pat. No. 9,673,503, and a continuation-in-part of application No. 15/078,086, filed on Mar. 23, 2016.

(60) Provisional application No. 62/140,390, filed on Mar. 30, 2015.

(51) Int. Cl.

| | |
|---|---|
| ***H01P 5/12*** | (2006.01) |
| ***H01P 5/19*** | (2006.01) |
| ***H01P 5/02*** | (2006.01) |
| ***H01P 11/00*** | (2006.01) |

(52) U.S. Cl.
CPC ..... *H01P 5/19* (2013.01); *H01P 5/02* (2013.01); *H01P 11/002* (2013.01)

(58) Field of Classification Search
CPC ..... H01P 5/19; H01P 5/02; H01P 11/002
USPC ..... 333/136
See application file for complete search history.

(56) References Cited

U.S. PATENT DOCUMENTS

| | | | |
|---|---|---|---|
| 2,946,965 | A | 7/1960 | Albanese |
| 3,931,587 | A | 1/1976 | Harp et al. |
| 4,032,865 | A | 6/1977 | Harp et al. |
| 4,152,680 | A | 5/1979 | Harrison |
| 4,188,590 | A | 2/1980 | Harp et al. |
| 4,238,747 | A | 12/1980 | Harp et al. |

(Continued)

OTHER PUBLICATIONS

Kenneth J. Russell, 'Microwave power combining techniques,' IEEE Transactions on Microwave Theory and Techniques, May 1979, pp. 472-478.

(Continued)

*Primary Examiner* — Robert Pascal
*Assistant Examiner* — Kimberly Glenn
(74) *Attorney, Agent, or Firm* — Malhotra Law Firm, PLLC; Deepak Malhotra

(57) ABSTRACT

A power combiner/divider includes a main conductor; a ground conductor radially exterior of the main conductor; an input connector having a center conductor electrically coupled to the main conductor and having a second conductor electrically coupled to the ground conductor; a conductive cylinder including an inner cylindrical surface radially exterior of and spaced apart from the main conductor, including an outer cylindrical surface; a second ground conductor radially exterior of the outer cylindrical surface of the conductive cylinder, a gap being defined between the second ground conductor and the outer surface of the conductive cylinder; a plurality of output connectors, the output connectors having center conductors electrically coupled to the conductive cylinder and having respective second conductors electrically coupled to the second ground conductor; and means for receiving and retaining a gas inside the divider/combiner. Methods of manufacturing are also disclosed.

20 Claims, 15 Drawing Sheets

(56) References Cited

U.S. PATENT DOCUMENTS

| | | | | |
|---|---|---|---|---|
| 4,266,208 | A | 5/1981 | Cornish | |
| 4,453,139 | A | 6/1984 | Labaar | |
| 4,598,254 | A | 7/1986 | Saito et al. | |
| 4,694,260 | A | 9/1987 | Argintaru et al. | |
| 4,700,145 | A | 10/1987 | Yelland | |
| 4,835,496 | A | 5/1989 | Schellenberg et al. | |
| 5,142,253 | A * | 8/1992 | Mallavarpu ..... | H01P 5/12 333/127 |
| 5,389,890 | A | 2/1995 | Burrage | |
| 5,644,272 | A | 7/1997 | Dabrowski | |
| 5,777,527 | A | 7/1998 | Sanders | |
| 5,784,033 | A | 7/1998 | Boldissar, Jr. | |
| 5,847,625 | A | 12/1998 | Gillette | |
| 6,005,450 | A | 12/1999 | Schmidt et al. | |
| 6,018,277 | A | 1/2000 | Vaisanen | |
| 6,919,776 | B1 | 7/2005 | Mobius et al. | |
| 7,102,459 | B1 | 9/2006 | Arnold et al. | |
| 7,215,218 | B2 | 5/2007 | Burns et al. | |
| 7,397,328 | B2 | 7/2008 | Yasuda et al. | |
| 7,468,640 | B2 | 12/2008 | Nosaka | |
| 7,479,850 | B2 | 1/2009 | Kearns et al. | |
| 8,508,313 | B1 | 8/2013 | Aster | |
| 9,065,163 | B1 | 6/2015 | Wu | |
| 9,673,503 | B1 | 6/2017 | Aster | |
| 2013/0335162 | A1 | 12/2013 | Sun | |

OTHER PUBLICATIONS

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. C. Temes and S. K. Mitra, Modern Filter Theory and Design, John Wiley & Sons, New York, New York, 1973, pp. 306-308.

"Choosing the Best Power Divider for the Task of Signal Combining" retrieved from: http://www.microlab.fxr.com/resource-library?brand=Microlab&go=application_notes, downloaded and printed on Feb. 6, 2016 (6 pages).

"Reactive vs. Wilkinson Splitters" retrieved from: http://www.microlab.fxr.com/resource-library?brand=Microlab &go=application_notes, downloaded and printed on Feb. 6, 2016 (2 pages).

"Dividers & Combiners" retrieved from: http://www.microlab.fxr.com/resource-library?brand=Microlab&go=application_notes, downloaded and printed on Feb. 6, 2016 (4 pages).

Wilkinson, Ernest J., An N-Way Hybrid Power Divider, Jan. 1960, pp. 116-118, IRE Transactions on Microwave Theory and Techniques.

Horton, M.C., and Wenzel, R.J., General Theory and Design of Optimum Quarter-Wave TEM Filters, May 1965, pp. 316-327, IEEE Transactions on Microwave Theory and Techniques.

First Office Action, dated Jul. 5, 2016, in U.S. Appl. No. 15/043,570, invented by the inventor thereof.

Second Office Action, dated Nov. 17, 2016, in U.S. Appl. No. 15/043,570, invented by the Inventor hereof.

Jul. 20, 2017 office action in U.S. Appl. No. 15/078,086.

Jul. 14, 2017 office action in U.S. Appl. No. 15/493,074.

Matthaei, Young, and Jones, Microwave Filters, Impedance-Matching Networks, and Coupling Structures, 1980, p. 302, Artech House Books.

Patzelt and Arndt, Double-Plane Steps in Rectangular Waveguides and their Application for Transformers, Irises, and Filters, pp. 772-776, May 5, 1982, IEEE Transactions on Microwave Theory and Techniques.

Whinnery, Jamieson, and Robbins, Coaxial-Line Discontinuities, p. 695, Nov. 1944, Proceedings of the I.R.E.

Semi-Flexible Air Dielectric Coaxial Cables and Connectors, 50 Ohms, EIA Standard RS-258, Mar. 1962, Table 1 and pp. 5-6.

Unpublished U.S. Appl. No. 15/078,086, filed Mar. 23, 2016.

Unpublished U.S. Appl. No. 15/493,074, filed Apr. 20, 2017.

Unpublished U.S. Appl. No. 15/582,533, filed Apr. 28, 2017.

Unpublished U.S. Appl. No. 15/614,572, filed Jun. 5, 2017.

* cited by examiner

Section 3 - 3

Section 6 - 6

Section 7 - 7

Section 8 - 8

$Z_S = Z_L = 50$ ohms
$Z_1 = 36.8$ ohms
$Z_2 = 19.1$ ohms
$Z_3 = 7.7$ ohms
$Z_{SH} = 7.1$ ohms
$Z_L/N = 5.0$ ohms

300 →

POWER COMBINERS AND DIVIDERS INCLUDING CYLINDRICAL CONDUCTORS AND CAPABLE OF RECEIVING AND RETAINING A GAS

CROSS REFERENCE TO RELATED APPLICATION

This is a continuation-in-part of U.S. patent application Ser. No. 15/043,570, filed Feb. 14, 2016, and a continuation-in-part of U.S. patent application Ser. No. 15/078,086, filed Mar. 23, 2016, both of which in turn claim priority to U.S. Provisional Patent Application Ser. No. 62/140,390, filed Mar. 30, 2015, all of which were invented by the inventor hereof and all of which are incorporated herein by reference.

TECHNICAL FIELD

The technical field includes methods and apparatus for summing (or combining) the power of a number of isolator-protected power sources or for dividing power into a number of separate divided output signals.

BACKGROUND

The communications and radar industries have interest in reactive-type broadband high-power microwave dividers and combiners. Even though not all ports are RF matched, as compared to the Wilkinson power divider/combiner (see Ernest J. Wilkinson, "An N-way hybrid power divider," IRE Trans. on Microwave Theory and Techniques, January, 1960, pp. 116-118), the reactive-type mechanical and electrical ruggedness is an advantage for high-power combiner applications. This assumes that the sources to be combined are isolator-protected and of equal frequency, amplitude and phase. Another application is improving the signal-to-noise ratio of faint microwave communication signals using an antenna dish array connected to the reactive power combiner using phase length-matched cables. The signal from each dish antenna sees an excellent "hot RF match" into each of the N combining ports of the reactive power combiner and is therefore efficiently power combined with the other N−1 antenna signals having equal frequency, amplitude, and phase. However, the cable- and antenna-generated thermal noise signal into each port of the N-way power combiner (with uncorrelated phase, frequency and amplitude) sees an effective "cold RF match" and is thus poorly power combined. The signal-to-noise ratio improves for large values of the number of combiner ports N.

An example of a reactive combiner/divider example is described in U.S. Pat. No. 8,508,313 to Aster, incorporated herein by reference. Broadband operation is achieved using two or more stages of multiconductor transmission line (MTL) power divider modules. An 8-way reactive power divider/combiner 200 of this type is shown in FIGS. 4 and 5 of application Ser. No. 15/043,570. Described as a power divider, microwave input power enters coax port 201, which feeds a two-way MTL divider 202. Input power on the main center conductor 206 (FIG. 6*a*, Section a1-a1) is equally divided onto two satellite conductors 207 which in turn each feed quarter-wave transmission lines housed in module 203 (FIG. 4). Each of these quarter-wave lines feeds a center conductor 208 (FIG. 6*b*, Section a2-a2) in its respective four-way MTL divider module 204, power being equally divided onto satellite conductors 209 which in turn feed output coax connectors 205. This may also be described as a two-stage MTL power divider where the first stage two-way divider (Stage B, FIG. 7) feeds a second stage (Stage A, FIG. 7) consisting of two 4-way MTL power dividers, for a total of eight outputs 205 of equally divided power. This two-stage divider network is described electrically in FIG. 7 as a shorted shunt stub ladder filter circuit with a source admittance $Y_S^{(B)}$ and a load admittance $N_S^{(B)}N_S^{(A)}Y_L^{(A)}$. The first-stage (Stage B) quarter-wave shorted shunt stub transmission line characteristic admittances have values $Y_{10}^{(B)}$ and $N_S^{(B)}Y_{20}^{(B)}$, respectively, which are separated by a quarter-wave main line with characteristic admittance value $N_S^{(B)}Y_{12}^{(B)}$. Here the number of satellite conductors $N_S^{(B)}=2$, $N_S^{(A)}=4$ and $Y_{12}^{(B)}$ is the value of the row 1, column 2 element of the 3×3 characteristic admittance matrix $Y^{(B)}$ for the two-way MTL divider (Section a1-a1, FIG. 6). Also, $Y_{10}^{(B)}=Y_{11}^{(B)}+N_S^{(B)}Y_{12}^{(B)}$ and $Y_{20}^{(B)}=Y_{22}^{(B)}+Y_{12}^{(B)}+Y_{23}^{(B)}$. Each quarter-wave transmission line within housing 203 (FIG. 4) has characteristic admittance $Y_T$ and is represented in the equivalent circuit FIG. 7 as a quarter-wave main transmission line with characteristic admittance $N_S^{(B)}Y_T$. The second stage (Stage A) quarter-wave shorted shunt stub transmission line characteristic admittances have values $N_S^{(B)}Y_{10}^{(A)}$ and $N_S^{(B)}N_S^{(A)}Y_{20}^{(A)}$, respectively, which are separated by a quarter-wave main line with characteristic admittance $N_S^{(B)}N_S^{(A)}Y_{12}^{(A)}$. Here $Y_{12}^{(A)}$ is the value of the row 1, column 2 element of the 5×5 characteristic admittance matrix $Y^{(A)}$ for one of the two identical four-way MTL divider modules 204 (FIG. 4) with cross-section a2-a2 in FIG. 6*b*. A plot of scattering parameters for an octave bandwidth two-stage eight-way divider is shown in FIG. 4*c* of U.S. Pat. No. 8,508,313. Due to its complexity, the two-stage, three MTL module power divider/combiner as shown in FIGS. 4 and 5 is expensive to fabricate.

SUMMARY

Some embodiments provide a power divider/combiner comprising a main conductor defining an axis; a ground conductor radially exterior of the main conductor; an input connector having a center conductor, electrically coupled to the main conductor and having an axis aligned with the main conductor axis, and having a second conductor electrically coupled to the ground conductor; a conductive cylinder including an inner cylindrical surface radially exterior of and spaced apart from the main conductor, including an outer cylindrical surface, and having a cylinder axis coincident with the main conductor axis; a second ground conductor radially exterior of the outer cylindrical surface of the conductive cylinder, a gap being defined between the second ground conductor and the outer surface of the conductive cylinder; a plurality of output connectors having respective axes that are perpendicular to the main conductor axis, the output connectors being angularly spaced apart relative to each other, the output connectors having center conductors electrically coupled to the conductive cylinder and having respective second conductors electrically coupled to the second ground conductor; and means for receiving and retaining a gas inside the divider/combiner when the divider/combiner is in use with cables coupled to the input connector and output connectors.

Other embodiments provide a power divider/combiner including a stepped main conductor defining an axis; a ground conductor radially exterior of the stepped main conductor; an input connector having a center conductor, adapted to be coupled to a signal source, electrically coupled to the main conductor and having an axis aligned with the main conductor axis, and having a second conductor electrically coupled to the ground conductor, the power divider/ combiner having a first end defined by the input connector and having a second end; a conductive cylinder including an inner cylindrical surface radially exterior of and spaced apart from the main conductor, including an outer cylindrical surface, and having a cylinder axis coincident with the main conductor axis; a second ground conductor radially exterior of the outer cylindrical surface of the conductive cylinder, a gap being defined between the second ground conductor and the outer surface of the conductive cylinder; a plurality of output connectors, proximate the second end, having respective axes that are perpendicular to the main conductor axis, the output connectors having center conductors electrically coupled to the conductive cylinder and having respective second conductors electrically coupled to the second ground conductor; an inner flange that is electrically and thermally conducting, between the first and second ends, radially exterior of the main conductor, the output connectors having center conductors electrically coupled to the conductive cylinder; and a threaded bore extending from exterior of the divider/combiner into the second ground conductor, a passage from the threaded bore to the gap defined between the second ground conductor and the outer surface of the conductive cylinder, and a threaded plug selectively received in and plugging the threaded bore.

Still other embodiments provide a method of manufacturing a power divider/combiner, the method including providing a stepped main conductor defining an axis; providing a coax input connector having a center conductor, adapted to be coupled to a signal source and having an axis aligned with the main conductor axis, the coax input connector being electrically coupled to the input connector to the main conductor; providing a hollow cylindrical conductor radially exterior of and spaced apart from the main conductor, having a cylinder axis aligned with the main conductor axis, having an outer cylindrical surface; providing a plurality of coax output connectors having respective axes that are perpendicular to the main conductor axis, the output connectors being radially spaced apart relative to each other, the output connectors having center conductors electrically coupled to the cylinder conductor; and providing a chamber capable of receiving and retaining a gas inside the divider/combiner when the divider/combiner is in use.

DETAILED DESCRIPTION OF THE ILLUSTRATED EMBODIMENTS

Figure 1:
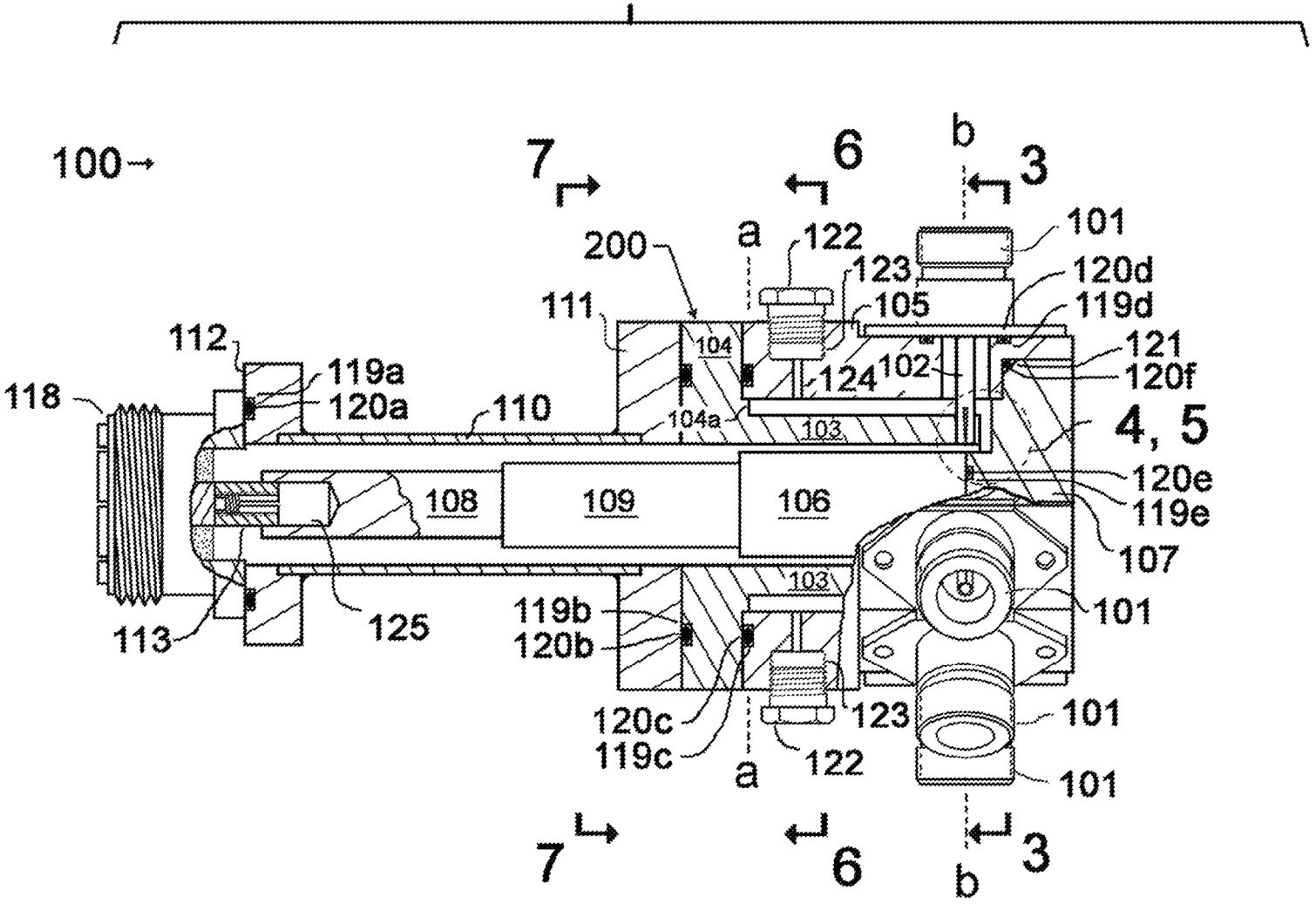
FIG. 1 is a side view of a power divider/combiner in accordance with various embodiments, partly in section.

FIG. 1 shows a microwave power divider 100, which can alternatively be used as a power combiner, in accordance with various embodiments. It will hereinafter be referred to as a power divider-combiner 100.

Hereinafter described as if for use as a power divider, the power divider-combiner 100 has (see FIGS. 1 and 13) a single main input port flange 112, and a quantity N of output port connectors 101. It is to be understood that, for convenience, the terms "input" and "output", when used herein and in the claims, assume that the divider-combiner is being used as a power divider. The roles of the inputs and outputs are reversed when the divider-combiner is being used as a power combiner.

In the illustrated embodiments, the power divider-combiner 100 (see FIG. 1) has, at a forward end, an input RF connector 118 which is 7-16 DIN female. Other embodiments are possible. For example, in the modified form of construction shown in FIG. 2, the input RF connector is ⅞ EIA consisting of flange 128 and a ⅞ EIA center conductor contact bullet assembly 300 (see FIG. 18) which may fabricated or purchased separately as part 34389A from Andrew Corporation. Other connector types, such as Type N (male or female), 1⅝ EIA, or SC (male or female), could be employed. In the illustrated embodiments, the divider-combiner 100 of FIG. 1 includes a center conductor contact bullet 113 that is received in bore 125 of a center conductor portion 108 which is described below in greater detail. Bullet 113 is either soldered or screwed onto the center conductor of RF connector 118. In the illustrated embodiments, the bullet 113 is slotted. The material for the bullet 113 may be, but is not limited to, any one of the following age-hardened alloys: BeCu, chrome copper, Consil, or phosphor bronze. The bullet 113 may be gold plated or silver plated with a rhodium flash for corrosion protection.

The power divider-combiner 100 further has (see FIGS. 1, 2, and 3) ten Type N (female) connectors for the output ports 101. Other types of output and input RF connectors are possible.

The power divider-combiner 100 includes a cylindrical conductor 103 defining, in some embodiments, the shape of or the general shape of a hollow cylinder (see FIGS. 6, 10, 11, and 12). Each output RF connector 101 has a center conductor 102 electrically connected with an outer end of the conductor 103.

Figure 3:
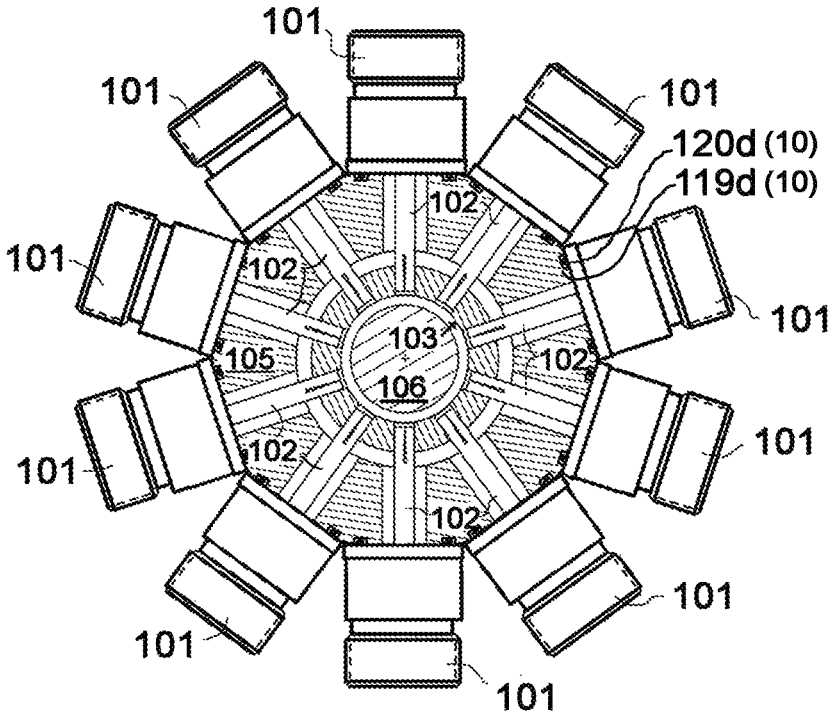
FIG. 3 is a sectional view taken along line 3-3 of FIG. 1 or FIG. 2.
Figure 4:
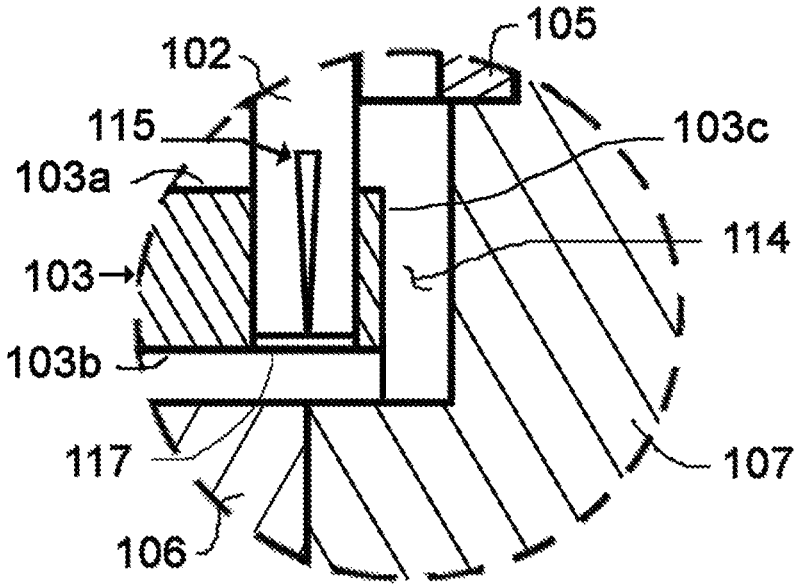
FIG. 4 is a partial cut-away view of the divider/combiner of FIG. 1 or FIG. 2 showing a connection point.
Figure 5:
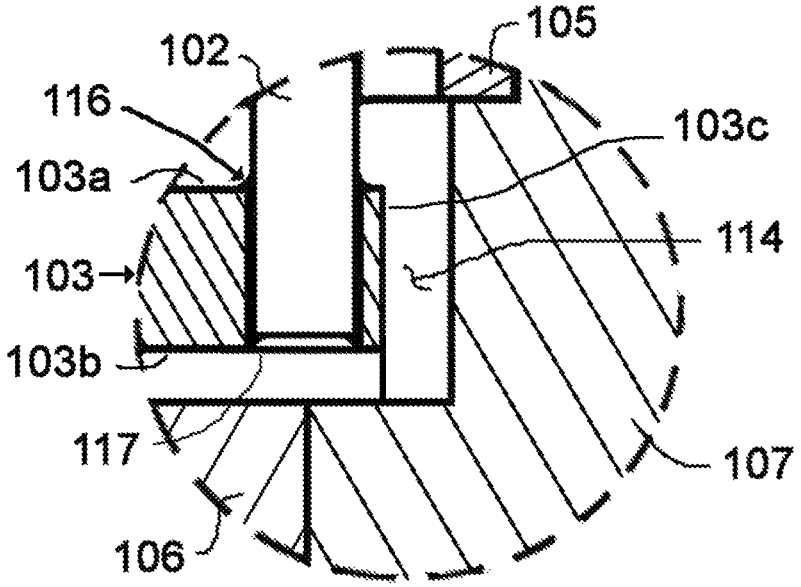
FIG. 5 is a partial cut-away view of the divider/combiner of FIG. 1 or FIG. 2 in accordance with alternative embodiments.
Figure 6:
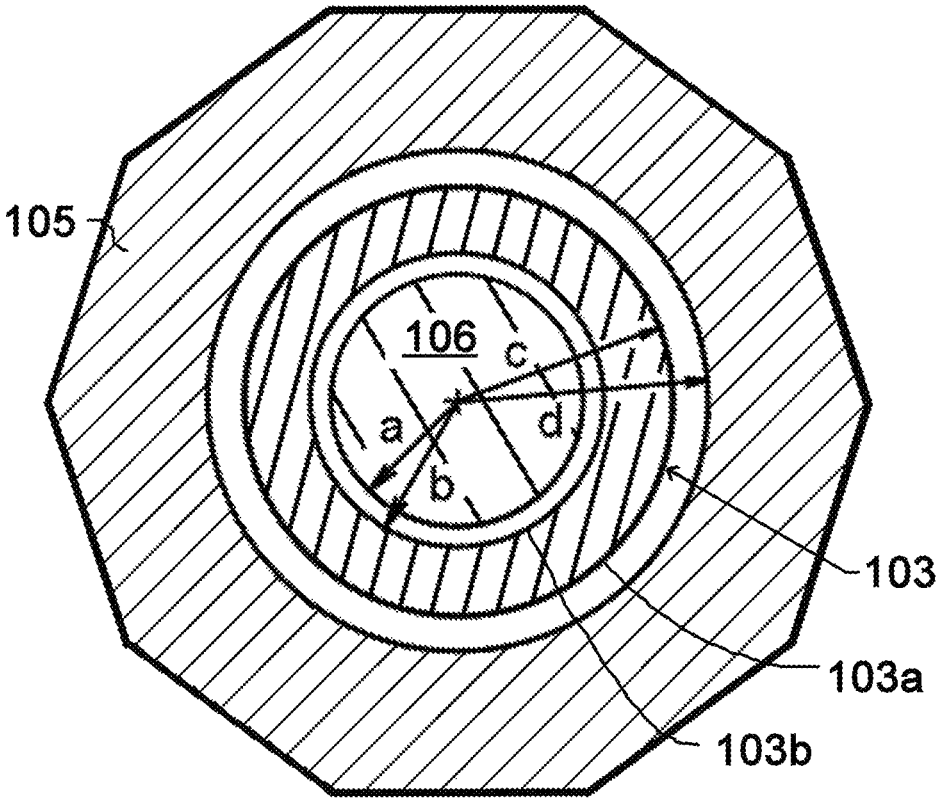
FIG. 6 is a sectional view taken along line 6-6 of FIG. 1 or FIG. 2.
Figure 7:
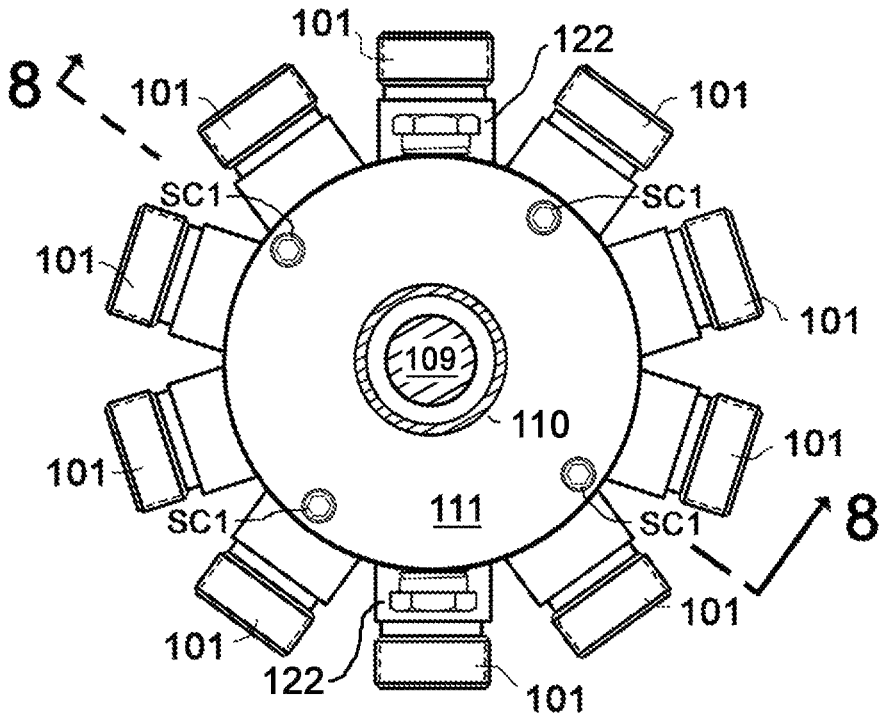
FIG. 7 is a sectional view taken along line 7-7 of FIG. 1 or FIG. 2.

FIG. 4 shows center conductor 102 with a slotted end 115 distal from the output port 101 (see FIG. 3) and compression fit into a receiving bore 117 located near an end of the conductor 103. FIG. 5 shows an alternative connection. In the embodiments of FIG. 5, the center conductor 102 is attached with solder or braze alloy 116 into the bore 117 to form the electrical and thermal connection to the conductor 103.

Figure 2:
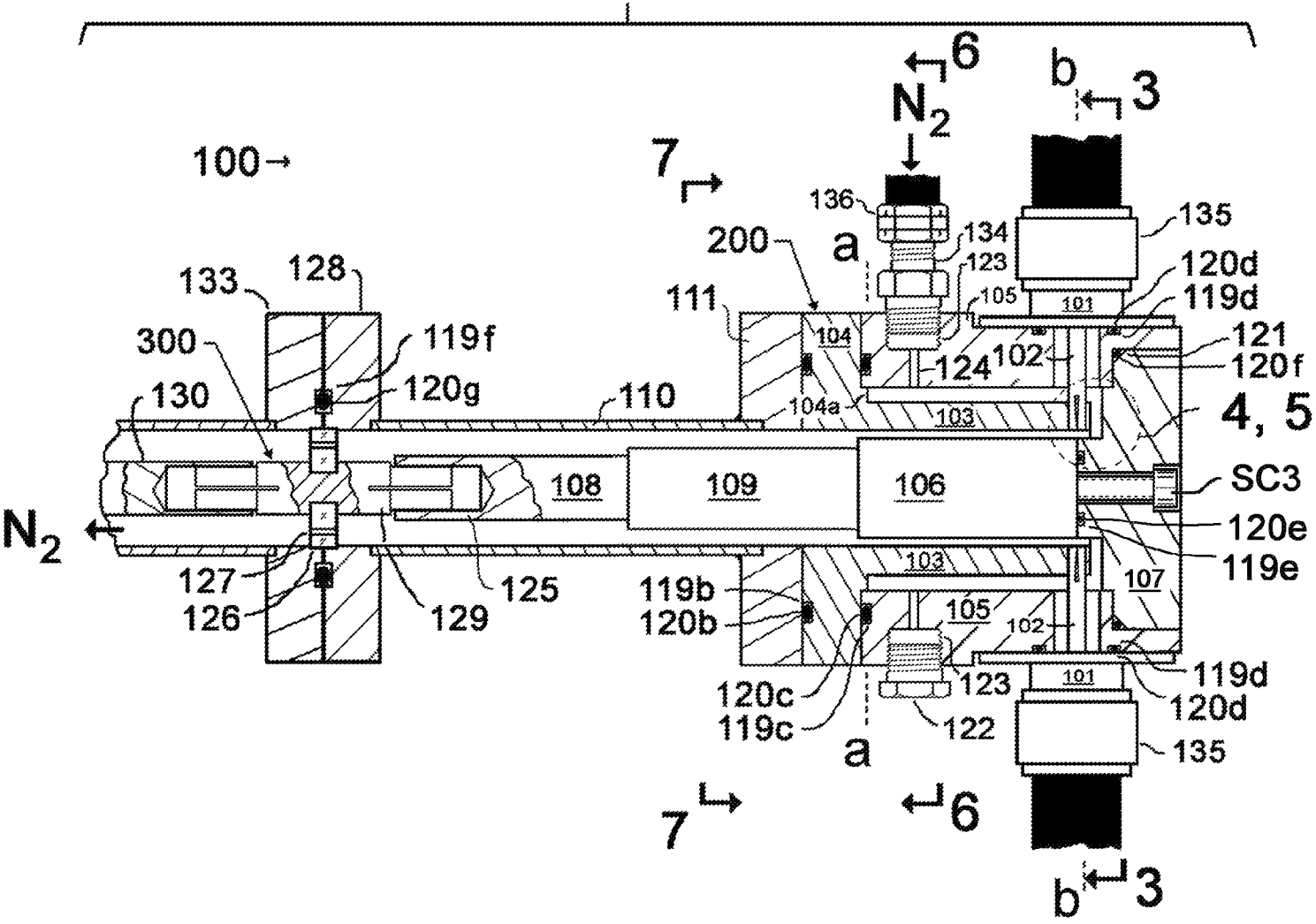
FIG. 2 is a modified form of construction of the power divider/combiner shown in FIG. 1 with cables attached and with a plug replaced with a pressure valve to allow the introduction of a gas.

The power divider-combiner 100 includes (see FIGS. 1, 2) a stepped diameter main center conductor including portions 108, 109, and 106 which are electrically connected to each other. The portions 108, 109, and 106 are cylindrical in the illustrated embodiments; however, other shapes are possible. FIG. 1 shows the electrical contact bullet 113 received in the bore 125 in the portion 108, in the illustrated embodiments. FIG. 2 shows a modified form of construction where one end of electrical contact bullet 129 of the ⅞ EIA bullet assembly 300 is received in a bore 125 in the center conductor portion 108. The customer's coax cable has a center conductor 130 that shares the EIA bullet assembly 300.

The power divider-combiner 100 further includes, at a rearward end, an electrically and thermally conducting outer back plate 107 to which portion 106 of the main center conductor electrically and mechanically connects.

In the illustrated embodiments, the power divider-combiner 100 further includes a sidewall or exterior ground conductor 105 that has a central aperture receiving conductor 103, with a gap between the ground conductor 105 and the conductor 103. The output RF connectors 101 are radially spaced apart relative to the portion 106, angularly spaced apart relative to each other, mounted to the sidewall 105, and their center conductors 102 pass through the sidewall 105. Further, the RF connector center conductors 102 define respective axes that are all perpendicular to an axis defined by the portion 106 of the main center conductor, in some embodiments. Other angles are possible, including in-line orientation of the RF output connectors relative to the main center conductor, and out the outer back plate 107, rather than through the sidewall conductor 105.

In the illustrated embodiments, the main center conductor portions 108, 109, 106, and the conductor 103 are substantially one-quarter an electrical wavelength long at the passband mid-band frequency $f_O$.

The power divider-combiner 100 further includes an inner flange 104 that is electrically and thermally conducting, in the illustrated embodiment. The cylindrical conductor 103 has a forward end that is electrically and thermally connected to the inner flange 104 and has an inner surface 103*b* spaced apart from portion 106 of the main center conductor (see FIGS. 4, 5, and 6).

The power divider-combiner 100 further includes exterior ground conductors 110 and 111. In some embodiments, (see FIG. 1) the exterior ground conductor 110 is soldered, brazed, or welded to exterior ground conductor 111 and to flange 112 or, in the modified form of construction (see FIG. 2), to flange 128. In various embodiments, an assembly (see FIG. 1) is defined by conductors 110 and 111, and flange 112, (or by conductors 110, 111, and flange 128 in the modified form of construction shown in FIG. 2), and the assembly may be gold or silver plated. In various embodiments, the stepped outer diameter portions 108, 109, and 106 of the main center conductor, and the inner diameters of the exterior ground conductors 110, 111, and 104, and the cylindrical conductor 103 define three unit element (quarter-wave) coaxial transmission lines. The outer diameter of the conductor 103 and the inner diameter of the ground conductor 105 and their connection to the flange 104 define a unit element (quarter-wave) transmission line shorted shunt stub 132 (see FIG. 15).

In the illustrated embodiments, FIG. 1 shows the power divider-combiner 100 further includes a circular O-ring groove 119*a* in a forward surface of input port flange 112, and an O-ring 120*a* in the groove 119*a*, so the O-ring 120*a* sits between and engages the input port flange 112 and the input connector 118. In the embodiments shown in FIG. 2, the forward surface of the ⅞ EIA flange 128 includes a circular O-ring half-groove 120*f* that engages a customer-supplied O-ring 120*g*, which is simultaneously engaged by a corresponding half-groove within the customer coax ⅞ EIA mating flange 133. In the illustrated embodiments, the power divider-combiner 100 further includes a circular O-ring groove 119*b* in a forward surface of inner flange 104, and an O-ring 120*b* in the groove 119*b*, so the O-ring 120*b* sits between and engages the cylinder ground conductor 111 and the flange 104. In the illustrated embodiments, the power divider-combiner 100 further includes a circular O-ring groove 119*c* in a rear surface of inner flange 104, and an O-ring 120*c* in the groove 119*c*, so the O-ring 120*c* sits between and engages the sidewall 105 and the flange 104. In the illustrated embodiments, the power divider-combiner 100 further includes angularly spaced-apart circular O-ring grooves 119*d* in a forward facing outer surface of the sidewall 105, and O-rings 120*d* in the grooves 119*d*, so the O-rings 120*d* sit between and engage the sidewall 105 and the output port connectors 101. The grooves 119*d* and O-rings 120*d* are also shown in FIG. 3. In the illustrated embodiments, the power divider-combiner 100 further includes a circular O-ring groove 119*e* in a forward facing surface of the rear back plate 107, and an O-ring 120*e* in the groove 119*e*, so the O-ring 120*e* sits between and engages the back plate 107 and the portion 106 of the main center conductor. Instead of a groove, in the illustrated embodiments, the outer back plate 107 has a circular 45 degree chamfer 121 in a forward facing radially exterior cylindrical surface, and the power divider-combiner 100 further includes an O-ring 120*f* in the chamfer 121, so the O-ring 120*f* sits between and engages the outer back plate 107 and a rearward facing surface of the sidewall 105. In the illustrated embodiments, O-ring 120*h* engages a circular O-ring groove 119*g* located within the head of cap screw SC2 (see FIGS. 8, 9, 10, and 11) and sits between the rear back plate 107 and cap screw SC2.

It should be apparent that when an O-ring is provided in a groove of one component that faces another component, the groove could instead be provided in the other component. For example, the groove 119*e* could be provided in the portion 106 of the main center conductor instead of in the outer back plate 107.

In the illustrated embodiments, the power divider-combiner 100 further includes threaded bores or apertures 123 extending inwardly from the radially exterior cylindrical surface of the sidewall 105. In the illustrated embodiments, the divider-combiner 100 further includes smaller diameter bores or apertures 124, aligned with the bores 123, and extending from the bores 123 to a gap between the sidewall 105 and the cylindrical conductor 103. In the illustrated embodiments, there are two bores 123 and they are ⅛ NPT threaded bores. In the illustrated embodiments, the power divider-combiner 100 further includes threaded sealing plugs 122 threadedly received in the bores 123. One or both of the plugs 122 may be removed and replaced with a pressure valve such as, for example, a Schrader (e.g., bicycle tube) pressure valves so that dry Nitrogen or arc suppression gas mixture may be introduced into the interior of the divider-combiner 100 via the bores 124. Other types of pressure valves may be used, such as Presta or Dunlop valves, for example.

There are several reasons why the O-rings 120*a-h*, threaded bores 123, bores 124, and plugs 122 are advantageous. In FIG. 1, with both plugs 122 replaced with Schrader valves by the customer, dry Nitrogen can be introduced through one Schrader valve and allowed to exit the other Schrader valve so as to purge moisture-laden air from the sealed divider/combiner interior. In alternative form of construction shown in FIG. 2, the four small bores 127 in the ⅞ EIA center conductor contact bullet 300 (see FIGS. 8, 18) allow dry nitrogen to flow throughout the length of a coax cable system, that includes the divider-combiner 100, to remove moisture condensation. In this case, only one plug 122 is removed and replaced with a Schrader valve which provides input gas flow. The other sealed plug 122 can remain in place or be replaced with a pressure gauge.

Figure 11:
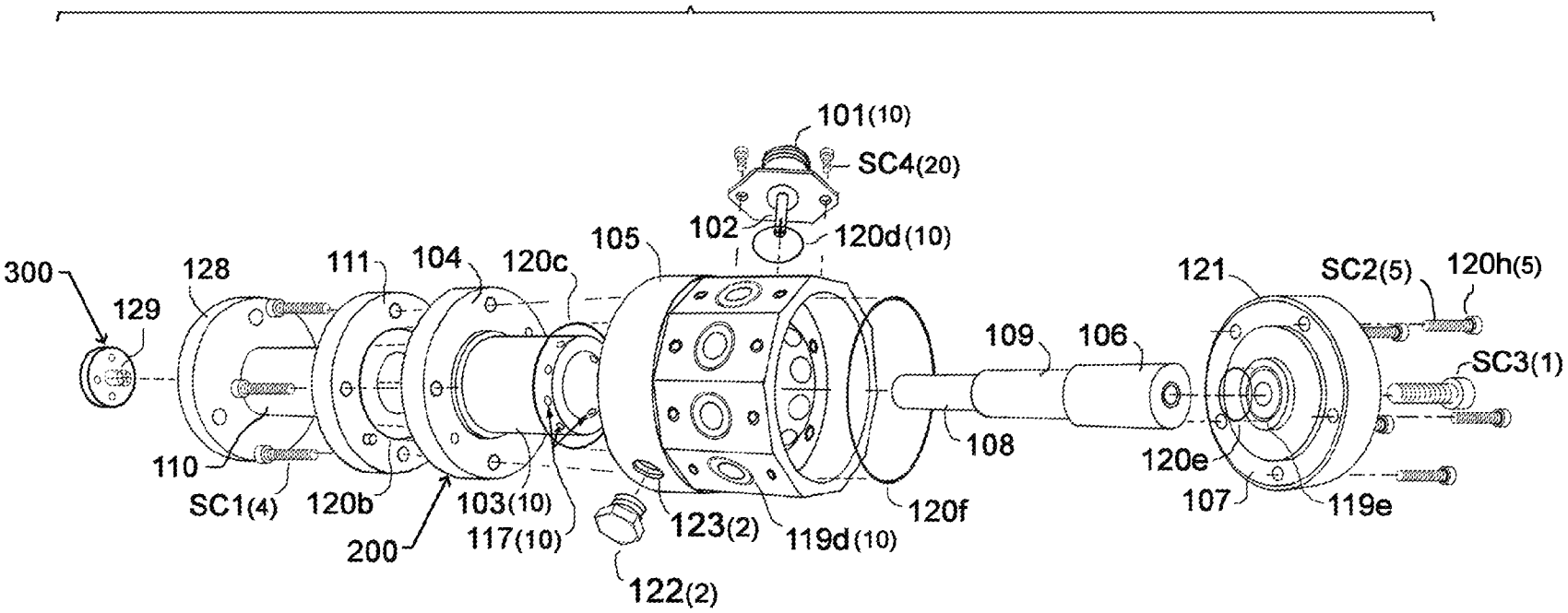
FIG. 11 is an exploded perspective view of the modified form of construction of the power divider/combiner as shown in FIG. 2.
Figure 18:
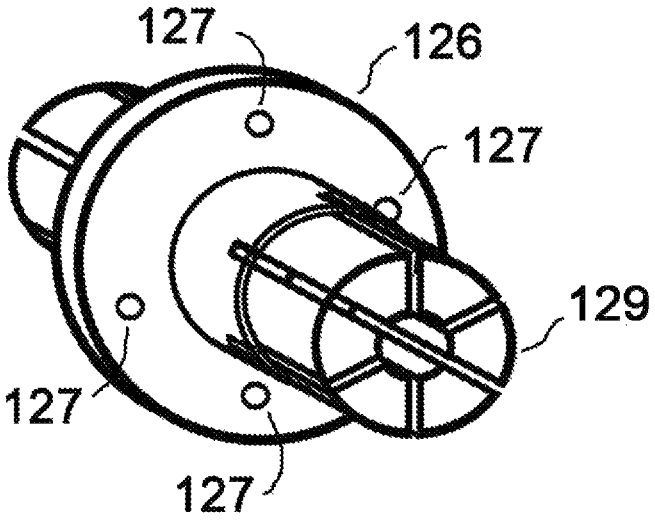
FIG. 18 is a perspective view of a conductor included in the alternative form of construction of the divider-combiner as shown in FIG. 1.

Consider a divider-combiner at one end of a long coax cable going up through a broadcast tower to another adapter connected to an antenna, for example. Winter environment can cause moisture condensation which may result in arcing within the cable assembly during broadcast operation. To prevent this from occurring, dry nitrogen (or de-humidified air) is introduced via the Schrader valve connection at one end of the cable assembly, and exits through another Schrader valve at the far end of the cable assembly. Referring to FIGS. 2, 11 and 18, ventilation holes 127 in the ⅞ EIA bullet assembly 300 dielectric 126 permit gas flow throughout the cable system. The O-rings 120*a-h* and at the EIA flange interfaces protect the cable interior from exterior moisture (cable jacket condensation or rainfall onto the cable system leading to the tower, for example), as well as preventing any leakage of the dry nitrogen flow.

Higher-pressure within the divider-combiner 100 and the connecting cable interior increases the air dielectric breakdown strength. The entire system including cables (see FIG. 2) may then withstand higher microwave power transmission.

In some microwave radar and countermeasure systems used in fighter aircraft, the microwave waveguide and cable system components are pressurized at ground level. For example, in FIG. 1 the 7-16 DIN RF connector O-ring 120*a* and the cable which connects to it (not shown) completely seals the forward end of the divider-combiner. Both plugs 122 may be replaced with Schrader valves and the divider-combiner interior then purged with moisture-free pressurized nitrogen or other pressurized gas mixture. Then the gas feed is removed, the Schrader valves are capped, and the divider/combiner 100 is expected to hold pressure for the duration of the flight mission. The O-rings 120*a-h* help maintain this interior pressure.

The O-rings 120*a-h* also allow the introduction of high-breakdown strength gas, such as sulfur hexafluoride. The O-rings 120*a-h* keep this expensive (and possibly toxic) gas contained in the divider-combiner 100. The divider-combiner 100 with O-rings 120*a-h* and built with a 7-16 DIN input connector 118 is sealed, in some embodiments. There are no ventilation holes in the connector dielectric. The divider-combiner 100 then uses two Schrader valves mounted so that the divider-combiner's interior may be successfully filled with the arc-protection gas compound.

Referring to FIG. 1, the electrical short 104*a* is located at reference plane a-a, and the shorted shunt stub 132 makes connection to the output connector center conductors 102 at reference plane b-b.

Figure 15:
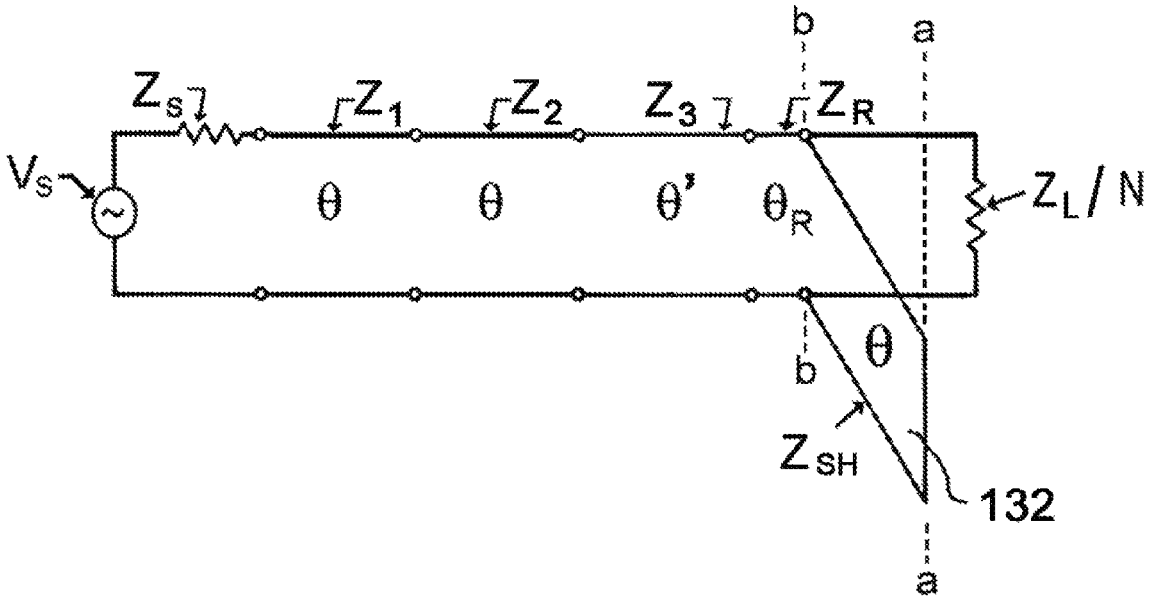
FIG. 15 is an equivalent circuit diagram for the divider/combiner shown in FIG. 1 or FIG. 2, when it is operated as a power divider.

Collectively, the three unit element transmission lines with characteristic impedances $Z_1$, $Z_2$, and $Z_3$ and the shorted shunt stub section with characteristic impedance $Z_{SH}$ are electrically modeled, in a generalized form, as a passband filter equivalent circuit shown in FIG. 15. A passband is a portion of the frequency spectrum that allows transmission of a signal with a desired minimum insertion loss by means of some filtering device. In other words, a passband filter passes a band of frequencies to a defined passband insertion loss vs. frequency profile. Desired filter passband performance is achieved by a two-step process:

1) Given a source impedance quantity $Z_S$, divider quantity (number of outputs) N, load impedance quantity $Z_L$/N and desired passband a) bandwidth, and b) input port return loss peaks within the passband, calculate the unit element transmission line characteristic impedances $Z_1$, $Z_2$, $Z_3$ and unit element shorted shunt stub characteristic impedance value $Z_{SH}$ (see FIG. 15). This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327.

2) After determining the above desired electrical transmission line characteristic impedances, then find corresponding diameters for the conductors 108, 109, and 106, and inner diameters of the ground conductors 110, 111, and 104 and of the conductor 103 which define unit element characteristic impedances-$Z_1$, $Z_2$, and $Z_3$. In addition, the outer diameter of the conductor 103 and the inner diameter of ground conductor 105 define the shorted shunt stub unit element characteristic impedance $Z_{SH}$. For example (referring to cross-section FIG. 6), the characteristic impedance $Z_3$ is defined according to the formula $Z_3=60*\log_e(b/a)$ where quantity b is the radius of the inner surface of the conductor 103, and where quantity a is the radius of the outer surface of the main center conductor portion 106. Similarly, the characteristic impedance $Z_{SH}$ is defined according to the formula $Z_{SH}=60*\log_e(d/c)$ where quantity d is the radius of the inner surface of the ground conductor 105, and quantity c is the outer radius of the conductor 103. The above expressions for impedances $Z_3$ and $Z_{SH}$ assume air or vacuum-dielectric, but other dielectric materials may be used along the lengths of unit element transmission lines corresponding to $Z_1$, $Z_2$, $Z_3$, and $Z_{SH}$, such as (but not limited to) Teflon, boron nitride, beryllium oxide, or diamond, for example.

Figure 16:
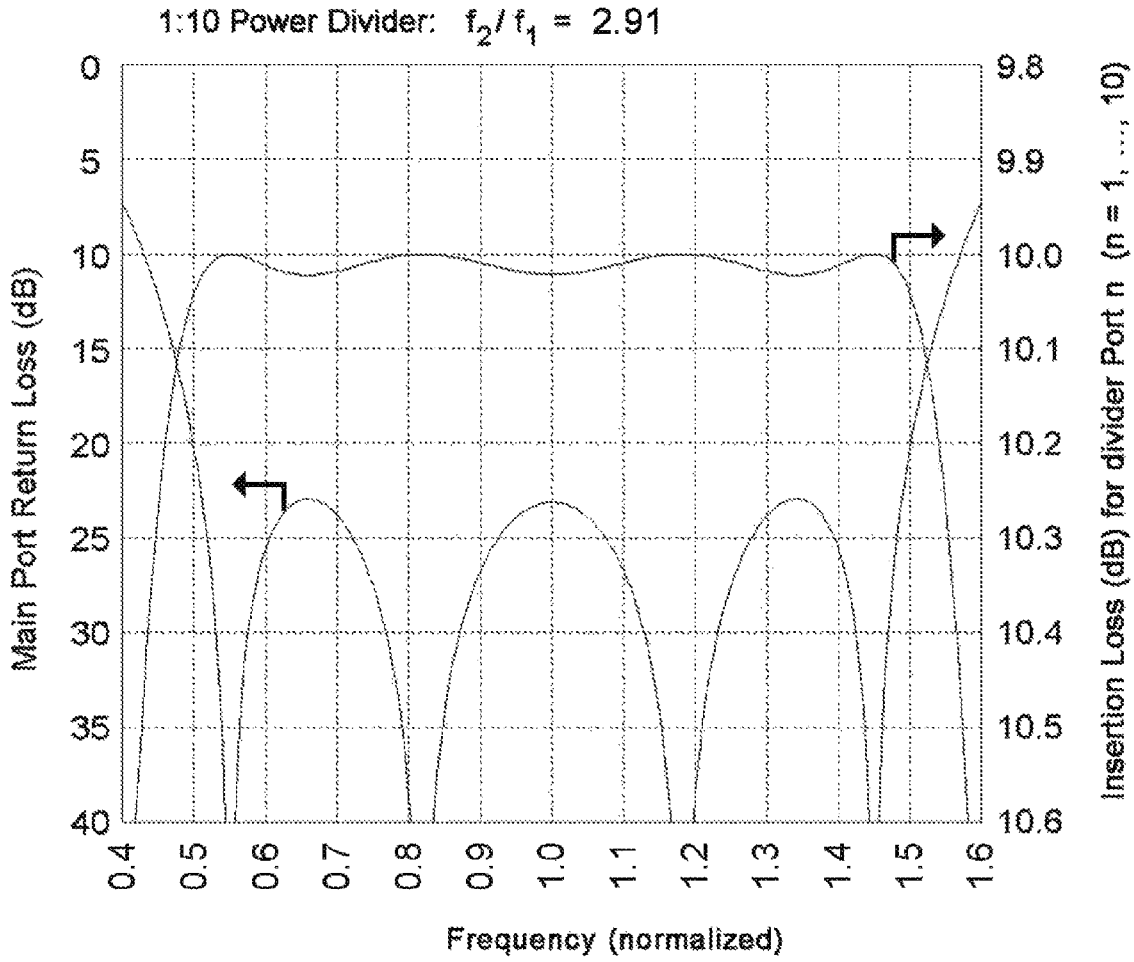
FIG. 16 is a graph showing typical input port return loss and output port insertion loss vs. frequency for embodiments of the divider-combiner of FIG. 1 or FIG. 2 that have one input port and ten output ports (when being used as a power divider).

As an example, given: N=10, $Z_S=Z_L=50$ ohms, 23 dB return loss peaks are desired for a bandwidth $F_2/F_1=2.91$, where $F_1$, $F_2$ represent the lower and upper edges of the passband, respectively. Using the Horton & Wenzel technique, unit element characteristic impedances $Z_1$, $Z_2$, $Z_3$ and the shorted shunt stub unit element characteristic impedance value $Z_{SH}$ were found. FIG. 16 shows calculated response using the derived characteristic impedances of the equivalent circuit in FIG. 15. Cross-section dimensions throughout the filter device were then determined so as to achieve these unit element characteristic impedances. While the illustrated embodiments show three main conductor coaxial transmission lines between the source $V_S$ and reference plane b-b (referring to the equivalent circuit shown in FIG. 15), alternative embodiments built for lesser or broader bandwidth employ one or two (narrower bandwidth) or four or more main conductor coax unit elements (broader bandwidth). The calculated scattering parameters $S_{11}, \ldots, S_{n1}$ plotted in FIG. 16 characterize a Chebyshev filter response throughout the passband $F_1$ through $F_2$. The Horton & Wenzel technique can also be used to find different values for $Z_1$, $Z_2$, $Z_3$, and $Z_{SH}$ to achieve other types of filter response such as, for example, maximally flat filter response.

Figure 17:
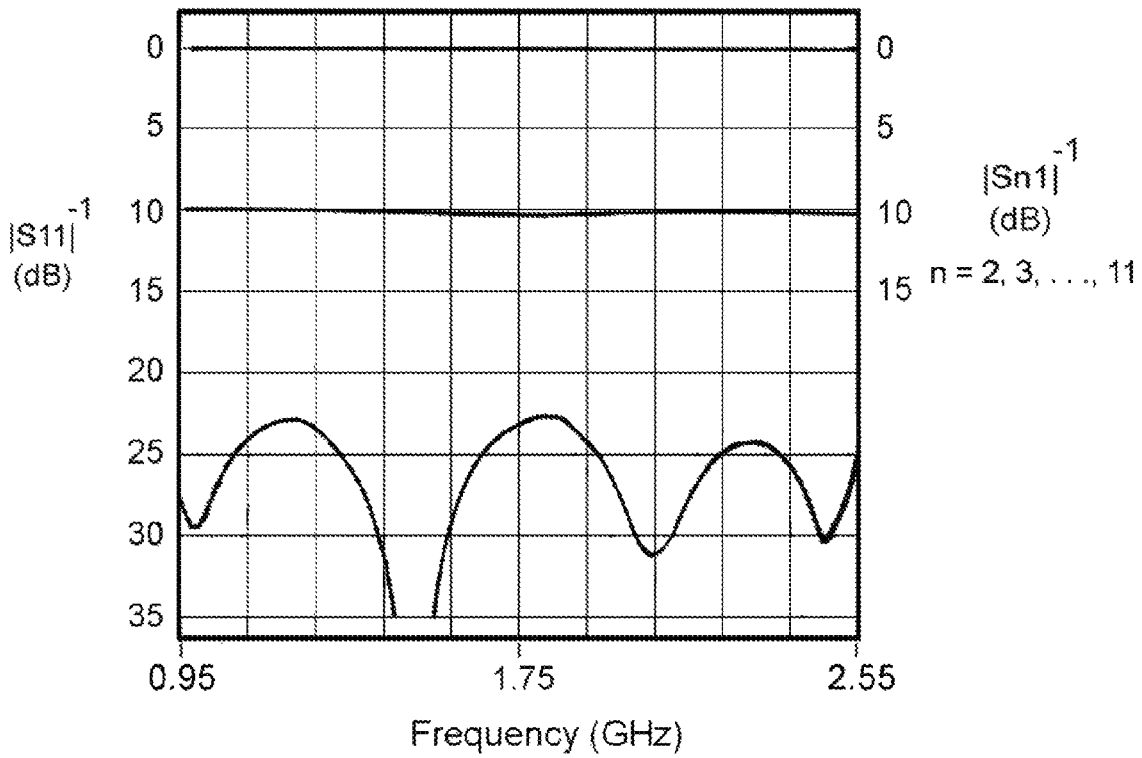
FIG. 17 shows measured RF performance of the divider/combiner of FIG. 2, tested as a power divider.

FIG. 17 shows measured RF performance of the divider-combiner of FIG. 1. Tested as a power divider, measured RF performance shows good correlation with predicted main port return loss $-20*\log_{10}(|S_{11}|)$ (dB) and typical output port insertion loss $-20*\log 10(|S_{n1}|)$ (dB) vs. frequency.

Various conductive materials could be employed for the conductive components of the power divider-combiner 100. For example, in some embodiments, the parts (other than those parts for which materials have been already described) are fabricated from 6061 alloy aluminum. For corrosion resistance, some of these parts may be a) alodine coated, or b) electroless nickel flash-coated and MlLspec gold plated. In other embodiments, parts are made of brass or magnesium alloy, also MlLspec gold plated. Another possibility is MlLspec silver plated, with rhodium flash coating to improve corrosion resistance.

Figure 9:
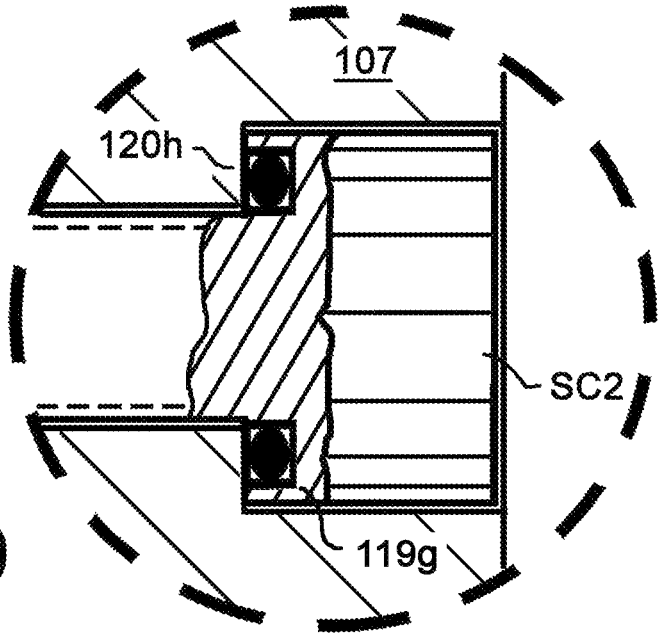
FIG. 9 is a partial cutaway view of the divider/combiner of FIG. 8 showing a cap screw O-ring seal embodiment.
Figure 10:
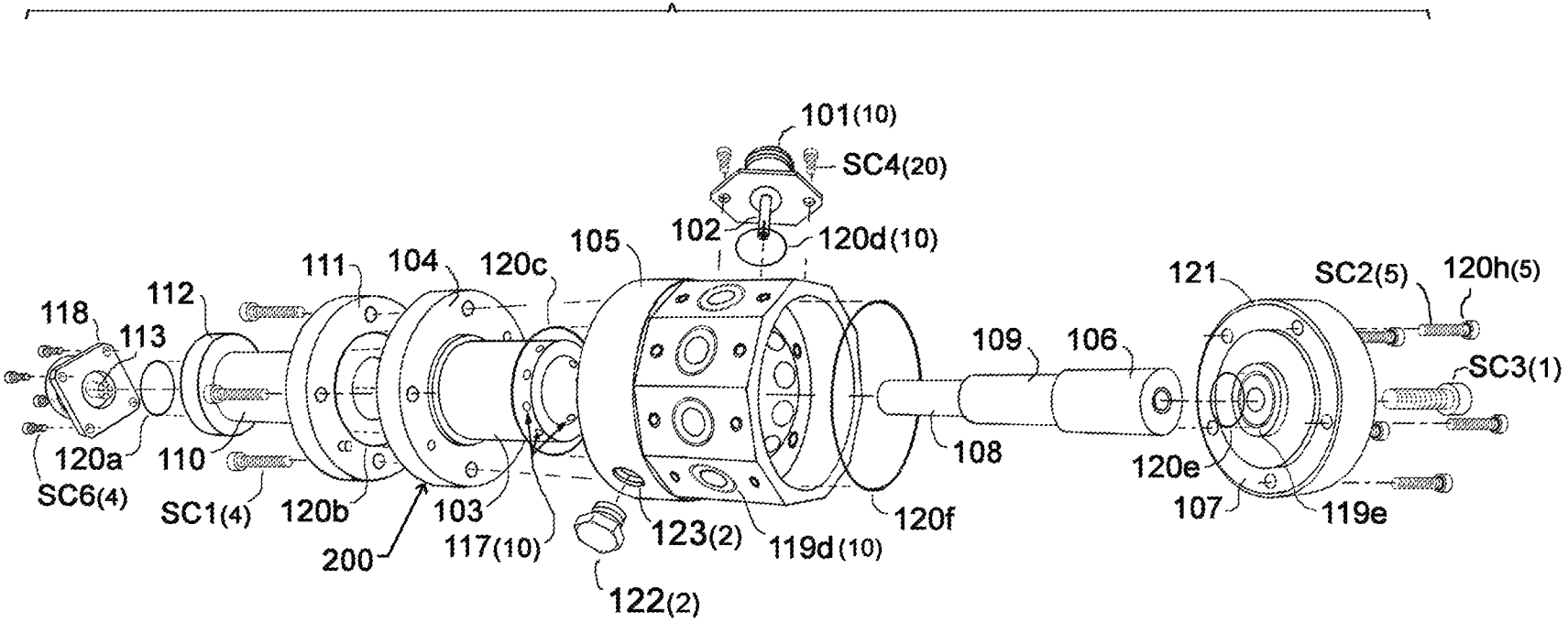
FIG. 10 is an exploded perspective view of the power divider/combiner of FIG. 1.

To better enable one of ordinary skill in the art to make and use various embodiments, FIGS. 10 and 11 show exploded views of the power divider-combiner 100 of FIGS. 1 and 2. In the illustrated embodiments, the 7-16 DIN female RF connector 118 is (see FIG. 1 and exploded view FIG. 10) mounted with four 6-32×0.375" socket head cap screws SC6. Referring to FIGS. 8, 9, 10, and 11, five 6-32×0.625" socket head screws SC2 each include an O-ring 120*h* contained in a groove 119*g* machined into the head of the cap screw (FIG. 9). In some embodiments, the screws SC2 that are employed are obtained from ZAGO Manufacturing. In the modified form of construction (FIG. 2 and exploded view FIG. 11), the ⅞ EIA bullet assembly 300 mates into flange 128 and simultaneously press-fit into receiving bore 125 in the divider-combiner 100 center conductor portion 108.

Figure 8:
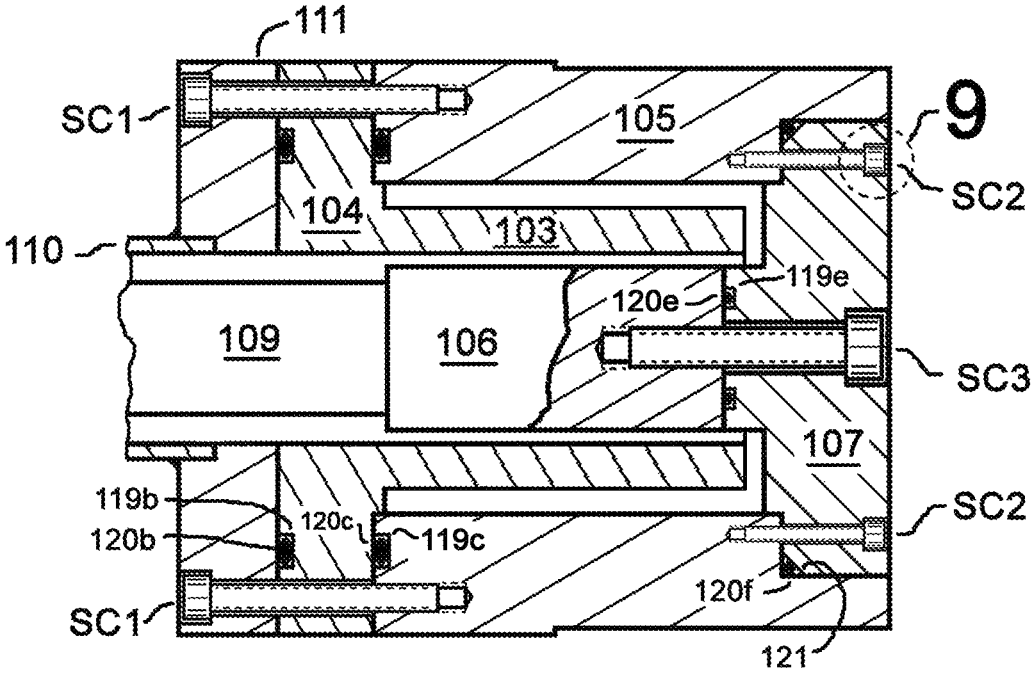
FIG. 8 is a sectional view taken along line 8-8 of FIG. 7.

The main stepped diameter center conductor, defined by the portions 108, 109, and 106, is fabricated as one piece, in the illustrated embodiments. It is bolted to the outer back plate 107 using a single ¼-20×¾" stainless steel cap screw SC3 (FIG. 8, 10, or 11). Other size screws or other methods of attachment can be employed. The portions 108, 109 and 106 are the center conductors for three unit element coaxial transmission lines.

Figure 12:
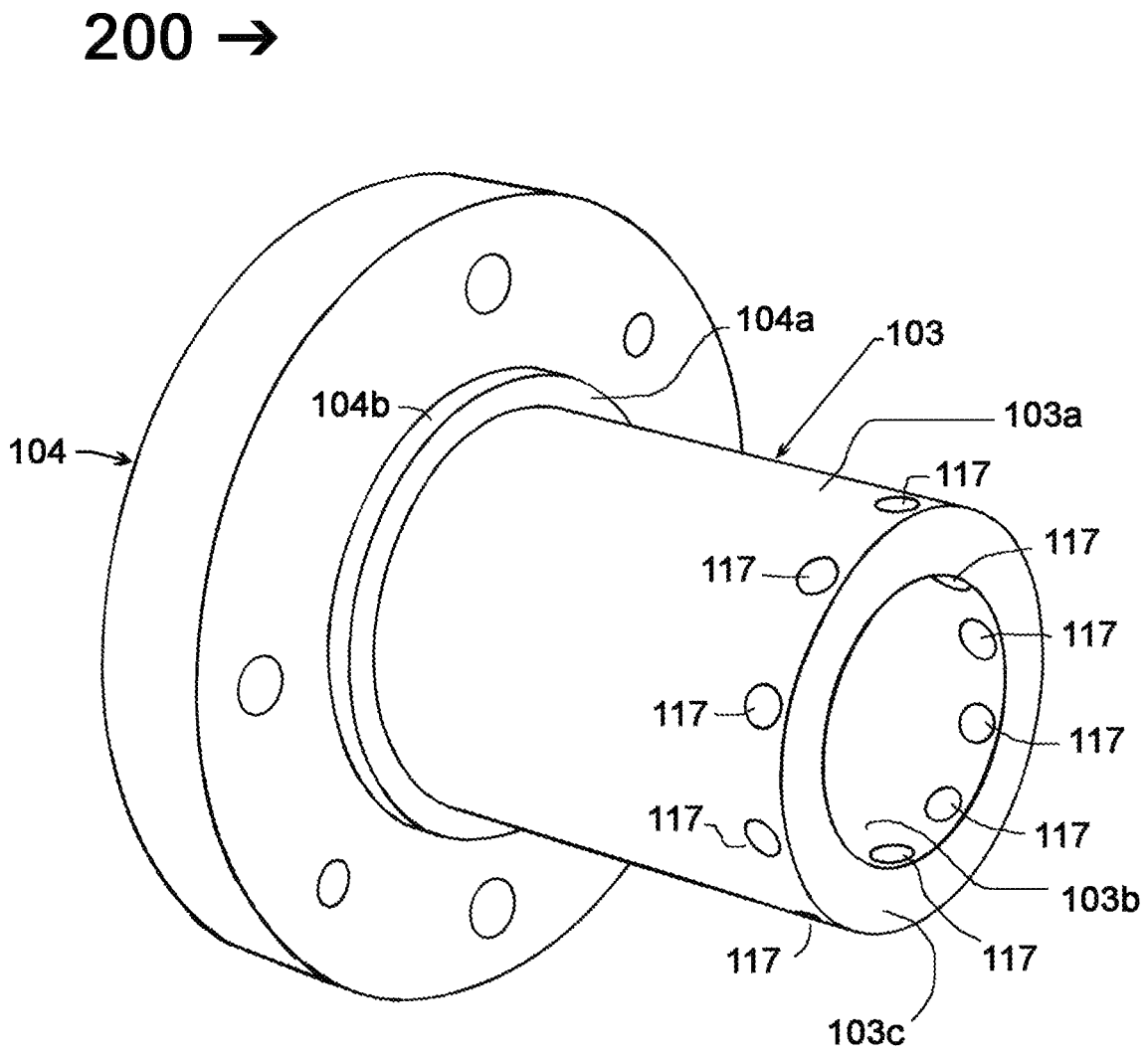
FIG. 12 is a perspective view of a conductor included in the divider/combiner of FIG. 1.

FIG. 12 shows a perspective view of a flange cylinder assembly 200 in accordance with various embodiments. In the illustrated embodiments, the flange cylinder assembly 200 includes the inner conducting flange 104 and the conductor 103. In the illustrated embodiments, the flange 104 and the conductor 103 are machined from a common piece. In alternative embodiments, the flange 104 and conductor 103 are separate pieces that are thermally and electrically connected together. The conductor 103 is bolted, soldered, or brazed, or press fit onto conducting flange 104 in alternative embodiments. The conductor 103 includes an outer conductive surface 103*a* that is cylindrical or generally cylindrical in the illustrated embodiments. The conductor 103 further includes an inner conductive surface 103*b* that is cylindrical or generally cylindrical in the illustrated embodiments. The flange cylinder assembly 200 includes a first end defined by the flange 104 and a second end 103*c*, defined by the conductor 103. The end 103*c* defines a radial line conductor surface. The flange 104 includes an alignment hub outer surface 104*b* and a short circuit conducting surface 104*a*. The outer surface 104*b* has an outer cylindrical surface having a diameter that is larger than the diameter of the outer cylindrical surface 103*a* of the conductor 103. The flange 104 also has an outer cylindrical surface having a diameter greater than the diameter of the surface 104*b*. Previously described apertures 117 for receiving center conductors 102 are shown.

Figure 13:
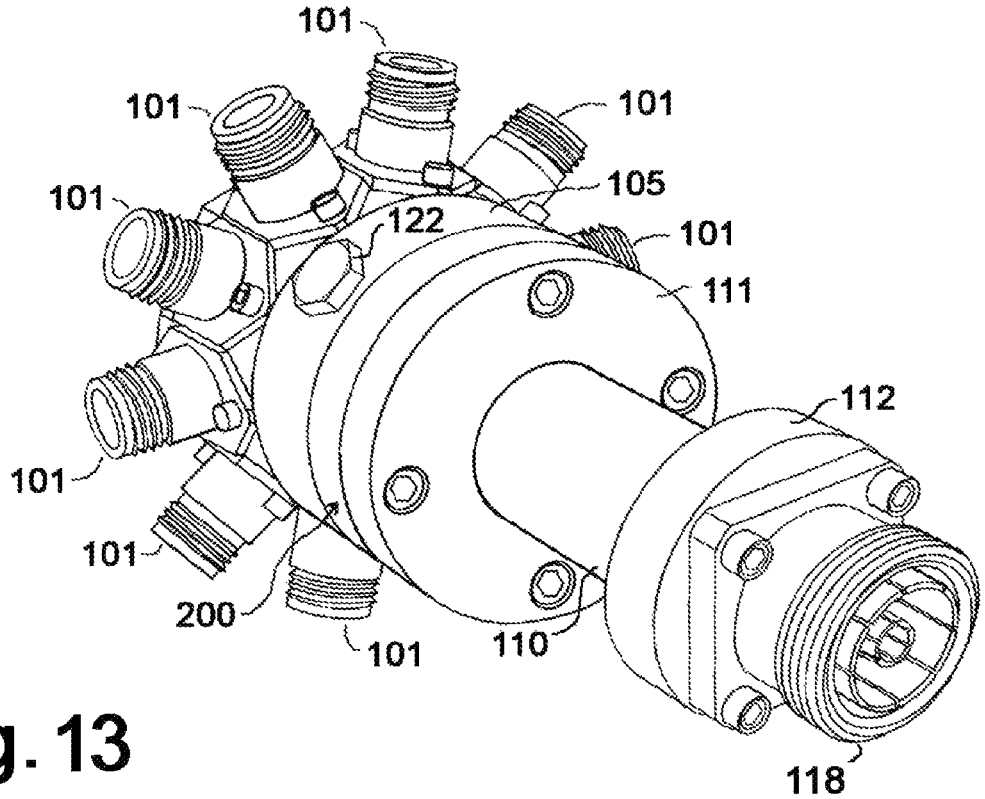
FIG. 13 is a perspective view of the divider-combiner of FIG. 1.
Figure 14:
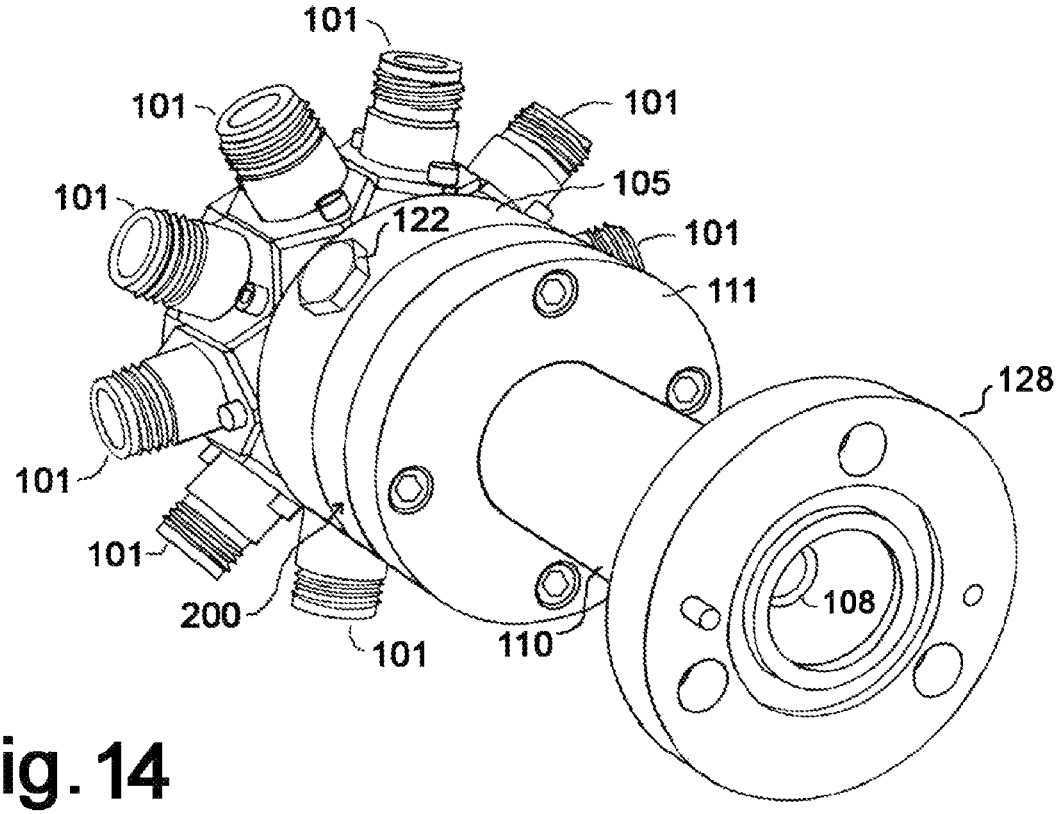
FIG. 14 is a perspective view of the modified form of construction of the divider-combiner as shown in FIG. 2.

FIG. 13 shows a perspective view of the power divider-combiner 100 of FIG. 10 after assembly. In the modified form of construction, FIG. 14 shows a perspective of the power divider-combiner 100 of FIG. 11 after assembly.

In the filter circuit synthesis technique as presented in the Horton & Wenzel reference, a desired circuit response (return loss over a passband as shown in FIG. 16, for example) results from the synthesis of transmission line characteristic impedances for a sequence of one or more unit element (substantially quarter-wave at the mid-band frequency $f_O$) transmission lines followed by a unit element shorted shunt stub transmission line connected in parallel with circuit load $Z_L/N$, as shown in FIG. 15 for this example.

Referring to FIG. 1 or 2, 3, 4, and 5 and the equivalent circuit shown in FIG. 15, the inner conductor 108 and the outer conductor 110 form a unit element (substantially quarter-wave) transmission line with characteristic impedance $Z_1$. The inner conductor 109, the inner surfaces of conductors 110, 111, and of flange 104 form a unit element transmission line with characteristic impedance $Z_2$. The inner conductor 106 and the inner surface 103*b* of the conductor 103 form a unit element transmission line with characteristic impedance $Z_3$, which has a unit element mid-band frequency phase length $\theta=\theta'+\theta_R$ where $\theta_R$ is the phase length of the radial transmission line 114 (FIGS. 4, 5) formed by the end 103*c* of the conductor 103 and the outer back plate 107. 1) Electrical reference plane a-a (FIG. 15) corresponds to the physical reference plane a-a shown in FIG. 1, where the flange 104 conducting surface 104*a* in FIG. 12 serves as the short circuit for a unit element shorted shunt stub 132 (FIG. 15). 2) Electrical reference plane b-b (FIG. 15) corresponds to the physical reference plane b-b shown in FIG. 1, where the shorted shunt stub 132 (FIG. 15) connects in parallel with output termination impedance quantity $Z_L/N$. 3) Between reference planes a-a and b-b (FIG. 15) is a unit element with characteristic impedance $Z_{SH}$. The above described unit elements are substantially one-quarter wavelength long at the passband mid-band frequency $f_O$. One way of interpreting a quarter-wavelength transmission line (at the mid-band frequency $f_O$) is that it 'transforms' the wave admittance on a Smith Chart along a circle about the origin (where the reflection coefficient magnitude is zero) exactly 180 degrees.

In the illustrated embodiments, the quantity N of output RF connectors equals ten, and the corresponding quantity N of receiving bores 117 (FIGS. 4, 5, 10, 11, and 12) in the conductor 103 equals ten. Other values of N=2, 3, . . . , 20 or more are possible. For example, a two-way divider-combiner has quantity N=2 equally spaced receiving bores 117 (and therefore N=2 output RF connectors).

In the illustrated embodiments, there are three coax unit elements having transmission line characteristic impedances $Z_1$, $Z_2$, and $Z_3$ (FIG. 15) with respective center conductor portions 108, and 109, and 106 (FIG. 1) that precede the junction for the ten output connectors at the physical reference plane b-b. However, for designs requiring less bandwidth, only one or two coax unit elements preceding the physical reference plane b-b may be used. Alternatively, four or more coax unit elements preceding physical reference plane b-b may be required for very broadband designs requiring very low VSWR (voltage standing wave ratio) throughout the passband, as measured at the divider input port.

In various embodiments, the flange 112 of FIG. 1 (or, in the modified form of construction, flange 128 of FIG. 2) and the conductor 110 are shown as separate pieces soldered, brazed, or welded together. Alternatively, the flange 112 and conductor 110 of FIG. 1 (or flange 128 and conductor 110 of FIG. 2) may be machined as one piece. Outer conductor 110 and the conductor 111, in the form of a flange, are shown in FIG. 1 as brazed or soldered together. Alternatively, conductor flange 111 may be bolted to a thick-walled conductor 110. Using four stainless steel cap screws SC1 from behind (see FIG. 10 or 11), flange 111 sandwiches flange 104 to thread into four corresponding threaded holes in the back face (hidden from view) of outer conductor 105, in various embodiments. Other mechanical attachment methods can be employed.

In the illustrated embodiments, the overall structure may alternatively be constructed (excluding the ten output connectors 101 and their respective center conductors 102) using 3D printing, followed by plating with an electrically conducting material.

Divider output connectors 101 (FIG. 1, 2, 3, 7, 10, 11, 13 or 14) are shown as flange mounted Type N (female) connectors. Each output connector (only one of ten connectors 101 is shown in FIG. 10 or 11) mounts to outer conductor 105 using two 4-40×3/16" cap screws SC4 (FIG. 10 or 11). Other Type N (female, or male) mounting types and other mechanical attachments can be employed. Other kinds of output RF connectors, such as TNC, SMA, SC, 7-16 DIN, 4.3-10 DIN male or female, and other EIA-type flanges can be employed. Press-fit, brazed or soldered non-flanged RF connectors may also be employed.

In the illustrated embodiments, the stepped center conductor plus back plate 108, 109, 106, 107 assembly is bolted to the end interior of MTL ground conductor 105 by means of five 6-32×5/8" stainless steel O-ring-sealed cap screws SC2 (FIG. 8, 9, 10 or 11). Other mechanical attachment methods can be employed.

In various embodiments, the conductive cylinder 103 is a solid conducting cylinder 103. This provides a superior thermal, electrical, and easier-to-fabricate design. Main port return loss, in some embodiments, measures approximately 23 dB or better over the frequency range 1.0 to 2.5 GHz, and divided power measures approximately −10 dB at one of the ten output ports.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A power divider/combiner comprising:

a main conductor defining an axis;

a first ground conductor radially exterior of the main conductor;

an input connector having a center conductor, electrically coupled to the main conductor and having an axis aligned with the main conductor axis, and having a second conductor electrically coupled to the ground conductor;

a conductive cylinder including an inner cylindrical surface radially exterior of and spaced apart from the main conductor, including an outer cylindrical surface, and having a cylinder axis coincident with the main conductor axis;

a second ground conductor radially exterior of the outer cylindrical surface of the conductive cylinder, a gap being defined between the second ground conductor and the outer surface of the conductive cylinder;

a plurality of output connectors having respective axes that are perpendicular to the main conductor axis, the output connectors being angularly spaced apart relative to each other, the output connectors having center conductors electrically coupled to the conductive cylinder and having respective second conductors electrically coupled to the second ground conductor; and means for receiving and retaining a gas inside the divider/combiner when the divider/combiner is in use with cables coupled to the input connector and output connectors.

2. A power divider/combiner in accordance with claim 1 wherein the means for receiving and retaining a gas comprises a threaded bore extending from exterior of the divider/combiner into the second ground conductor, a passage from the threaded bore to the gap defined between the second ground conductor and the outer surface of the conductive cylinder, and a threaded plug selectively received in and plugging the threaded bore.

3. A power divider/combiner in accordance with claim 1 wherein the input connector has a center conductor bullet, and wherein the main conductor has a bore receiving the center conductor bullet.

4. A power divider/combiner in accordance with claim 1 and having a first end defined by the input connector and having a second end, the output connectors being proximate the second end, and further comprising an inner flange that is electrically and thermally conducting, between the first and second ends, radially exterior of the main conductor, and wherein the means for receiving and retaining a gas comprises an O-ring sealingly arranged between the inner flange and the second ground conductor.

5. A power divider/combiner in accordance with claim 1 wherein the means for receiving and retaining a gas comprises an O-ring sealingly arranged between each output connector and the second ground conductor.

6. A power divider/combiner in accordance with claim 1 and further comprising an electrically and thermally conducting outer back plate at the second end electrically coupled to the main conductor and wherein the means for receiving and retaining a gas comprises a first O-ring sealingly arranged between the outer back plate and the second ground conductor.

7. A power divider/combiner in accordance with claim 1 wherein the first ground conductor has an outer diameter, and further comprising an input port flange having an outer diameter greater than the outer diameter of the first ground conductor, having an inner diameter, and electrically coupled to the first ground conductor, wherein the input connector is mechanically attached to the input port flange, and wherein the means for receiving and retaining a gas comprises an O-ring sealingly arranged between the input port flange and the input connector.

8. A power divider/combiner in accordance with claim 6 wherein the means for receiving and retaining a gas comprises a second O-ring sealingly arranged between the outer back plate and the main conductor.

9. A power divider/combiner comprising:

a stepped main conductor defining an axis;

a ground conductor radially exterior of the stepped main conductor;

an input connector having a center conductor, adapted to be coupled to a signal source, electrically coupled to the main conductor and having an axis aligned with the main conductor axis, and having a second conductor electrically coupled to the ground conductor, the power divider/combiner having a first end defined by the input connector and having a second end;

a conductive cylinder including an inner cylindrical surface radially exterior of and spaced apart from the main conductor, including an outer cylindrical surface, and having a cylinder axis coincident with the main conductor axis;

a second ground conductor radially exterior of the outer cylindrical surface of the conductive cylinder, a gap being defined between the second ground conductor and the outer surface of the conductive cylinder;

a plurality of output connectors, proximate the second end, having respective axes that are perpendicular to the main conductor axis, the output connectors having center conductors electrically coupled to the conductive cylinder and having respective second conductors electrically coupled to the second ground conductor;

an inner flange that is electrically and thermally conducting, between the first and second ends, radially exterior of the main conductor, the output connectors having center conductors electrically coupled to the conductive cylinder; and a threaded bore extending from exterior of the divider/combiner into the second ground conductor, a passage from the threaded bore to the gap defined between the second ground conductor and the outer surface of the conductive cylinder, and a threaded plug selectively received in and plugging the threaded bore.

10. A power divider/combiner in accordance with claim 9 and having a first end defined by the input connector and having a second end, the output connectors being proximate the second end, and further comprising an O-ring sealingly arranged between the inner flange and the second ground conductor.

11. A power divider/combiner in accordance with claim 9 and further comprising an O-ring sealingly arranged between each output connector and the second ground conductor.

12. A power divider/combiner in accordance with claim 9 and further comprising an electrically and thermally conducting outer back plate at the second end electrically coupled to the main conductor and an O-ring sealingly arranged between the outer back plate and the second ground conductor.

13. A power divider/combiner in accordance with claim 12 and further comprising O-ring sealed cap screws connecting the outer back plate to the second ground conductor.

14. A power divider/combiner in accordance with claim 9 wherein the first ground conductor has an outer diameter, and further comprising an input port flange having an outer diameter greater than the outer diameter of the first ground conductor, having an inner diameter, and between the first ground conductor and the input connector, and further comprising an O-ring sealingly arranged between the input port flange and the input connector.

15. A power divider/combiner in accordance with claim 13 and further comprising an O-ring sealingly arranged between the outer back plate and the main conductor.

16. A power divider/combiner in accordance with claim 9 and further comprising a chamber defined between the first ground conductor and the main conductor, the chamber being in fluid communication with the gap defined between the second ground conductor and the outer surface of the conductive cylinder.

17. A method of manufacturing a power divider/combiner, the method comprising:

providing a stepped main conductor defining an axis;

providing a coax input connector having a center conductor, adapted to be coupled to a signal source and having an axis aligned with the main conductor axis, the coax input connector being electrically coupled to the input connector to the main conductor;

providing a hollow cylindrical conductor radially exterior of and spaced apart from the main conductor, having a cylinder axis aligned with the main conductor axis, having an outer cylindrical surface;

providing a plurality of coax output connectors having respective axes that are perpendicular to the main conductor axis, the output connectors being radially spaced apart relative to each other, the output connectors having center conductors electrically coupled to the cylinder conductor; and providing a chamber capable of receiving and retaining a gas inside the divider/combiner when the divider/combiner is in use.

18. A method of manufacturing a power divider/combiner in accordance with claim 17 wherein the input conductor has a center conductor bullet, the method further comprising providing a bore in the main conductor to closely receive the conductor bullet, inserting the center conductor bullet in the bore in the center conductor, and performing one of soldering and screwing the bullet to the center conductor.

19. A method of manufacturing a power divider/combiner in accordance with claim 17 and further comprising providing a threaded bore, in fluid communication with the chamber, and a threaded plug, complementary to the threaded bore, plugging the threaded bore.

20. A method of manufacturing a power divider/combiner in accordance with claim 19 and further comprising removing the threaded plug and replacing the threaded plug with a pressure valve configured to be used to introduce a gas into the power divider/combiner.

* * * * *